United States Patent [19]

Sigle et al.

[11] Patent Number: 5,042,737

[45] Date of Patent: Aug. 27, 1991

[54] MULTIPLE WIRE DISPENSING ASSEMBLY

[75] Inventors: Ernest R. Sigle, R.R. #1, Box 30A, Council Grove, Kans. 66846; Christian P. Sigle, Council Grove, Kans.

[73] Assignee: Ernest R. Sigle, Council Grove, Kans.

[21] Appl. No.: 563,958

[22] Filed: Aug. 6, 1990

Related U.S. Application Data

[63] Continuation-in-part of Ser. No. 391,247, Aug. 9, 1989, abandoned.

[51] Int. Cl.[5] ..... B65H 59/04; B65H 75/30

[52] U.S. Cl. ..... 242/86.5 R; 242/86.7; 242/129

[58] Field of Search ..... 242/86.5 R, 85, 86.7, 242/99, 75.4, 129, 129.8, 156.1, 156, 55.42, 55.54, 129.6

[56] References Cited

U.S. PATENT DOCUMENTS

| | | | |
|---|---|---|---|
| 441,454 | 11/1890 | Vileyn | 242/129 |
| 809,721 | 1/1906 | Myers | 242/86.7 |
| 1,256,443 | 2/1918 | Demmien | 242/129.6 |
| 1,826,465 | 10/1931 | Gilman | 242/99 |
| 2,789,778 | 4/1957 | Zogg et al. | 242/86.7 |
| 3,107,878 | 10/1963 | Wong | 242/86.7 |
| 3,570,731 | 3/1971 | Waltz | 242/55.42 X |
| 3,937,414 | 2/1976 | Bank et al. | 242/86.5 R |
| 4,579,358 | 4/1986 | Byfield | 242/86.5 R X |
| 4,775,114 | 10/1988 | Farnsworth | 242/86.5 R |

*Primary Examiner*—John M. Jillions
*Attorney, Agent, or Firm*—Phillip A. Rein

[57] ABSTRACT

This invention relates to a multiple wire dispensing assembly which is interconnected to a three-point hitch assembly on a farm tractor assembly so as to be movable vertically and pivotally about a horizontal axis. The multiple wire dispensing assembly includes 1) a hitch connector assembly pivotally connected to the three-point hitch assembly on the farm tractor assembly; 2) a spindle support member connected to the hitch connector assembly; and 3) a plurality of spaced spindle support assemblies connected to the spindle support member. The spindle support assemblies each includes a spool support disc secured to the spindle support member; a central support member secured to a center of the spool support disc and, additionally, secured to the spindle support member; and an upright support shaft secured to the spindle support member and extended upwardly therefrom. The spool support disc has an upper concave surface adapted to receive a spool of wire thereon and to provide controlled frictional contact therewith when the wire strands from the respective spool of wire are to be trained therefrom. Another embodiment of this invention is an add-on multiple wire dispensing assembly including an axle and wheel support assembly secured to a trailer hitch assembly for connection to a tractor or pickup truck hitch member. This embodiment uses three of the spindle support assemblies mounted on a spindle support member and having add-on spindle support assemblies which can be releasably connected to opposite ends of the spindle support member for transforming the add-on multiple wire dispensing assembly from a three wire spool dispensing unit to a five wire spool dispensing unit.

11 Claims, 2 Drawing Sheets

MULTIPLE WIRE DISPENSING ASSEMBLY

This is a continuation-in-part of application Ser. No. 391,247, filed Aug. 9, 1989, now abandoned.

PRIOR ART

A patent search on this invention revealed the following U.S. Patents.

| U.S. Pat. No. | Invention | Inventor |
|---|---|---|
| 2,789,778 | WIRE DISPENSER | A. A. Zogg et al |
| 3,000,588 | MULTIPLE REELING DEVICE | S. A. Brady |
| 3,107,878 | MULTIPLE REEL CARRIER | H. B. Wong |
| 3,934,655 | HYDRAULIC POST SETTING AND WIRE DISPENSING APPARATUS | Bobby A. Whistle |
| 4,008,862 | BALE UNROLLING DEVICE | Raymond G. Wilmes |
| 4,208,021 | FENCING WIRE DISPENSER | John R. Wall |

ANALYSIS

The Wong patent discloses a multiple reel carrier mounted on a wheelbarrow type structure and having reel compensating features and separate brake structures.

The Brady patent discloses a rather elaborate trailer for unrolling heavy rolls of wire used in electrical power lines and has means to use gear and chain drives to insure the proper and accurate dispensing of the wire from the spools.

The Wall patent discloses a plurality of stacked coil members utilized for the same function but is substantially different structurally.

The Whistle patent discloses a rather elaborate post setting and wire dispensing apparatus attached to a tractor structure.

The Zogg et al patent teaches a wire dispensing structure attached to the three-point hitch on a farm tractor having pairs of wire spools which are rotated in opposite directions to act against each other as a brake when the tractor is stopped.

PREFERRED EMBODIMENT

In one preferred embodiment of this invention, a multiple wire dispensing assembly is operable to be attached to a three-point hitch assembly on a farm tractor assembly having a plurality of spools of wire thereon which are to be trailed therefrom and attached to spaced upright fence posts. The multiple wire dispensing assembly includes 1) a hitch connector assembly connected to the three-point hitch assembly on the farm tractor assembly; 2) a spindle support member connected to the hitch connector assembly; and 3) a plurality of spindle support assemblies which are secured to and equally spaced on a top surface of the spindle support member. The hitch connector assembly includes an upper support assembly interconnected to a lower support assembly. The upper support assembly is provided with a pair of parallel support arms interconnected at an upper end by a connector member and connected at a lower end to a lower support assembly. The lower support assembly includes parallel support bars interconnected by a transverse support bar and having an outer end thereof secured to the spindle support member. The spindle support member extends perpendicular to the parallel support bars and having the upper support surface. Each spindle support assembly includes 1) a spiral support disc secured to an upper surface of the spindle support member; 2) a central support member secured to a center portion of the spool support disc; and 3) an upright axle or shaft interconnected to the central support member and extended upwardly therefrom. The spindle support assembly is operable to receive a spool of wire thereon to 1) rest on an upper concave surface of the spool support disc; and 2) having the upright support axle or shaft extended through a central opening therein. The spools of wire are operable to be connected to spaced positions on the fence post and, on movement of the farm tractor assembly, the spools of wire are automatically rotated and controlled by frictional contact for the ease of construction of a fence post and wire assembly.

In another preferred embodiment of this invention, an add-on multiple wire dispensing assembly is operable to be attached to a trailer hitch member on a tractor or a pickup truck and having a plurality of spools of wire mounted thereon which are to be trailed therefrom and attached to spaced fence posts. The add-on multiple wire dispensing assembly includes 1) a trailer hitch connector assembly connectable to a tractor or pickup truck trailer hitch; 2) a main spindle support member connected to the trailer hitch connector assembly; 3) a plurality of spaced spindle support assemblies mounted on the spindle support member; and 4) add-on spindle support assemblies which are secured to opposite ends of the main spindle support member to extend from a plurality, namely three, spindle support members to a total of five or more. The trailer connector assembly includes an axle and wheel support assembly and having extended forwardly therefrom a trailer hitch assembly which is connected in a conventional manner to a pickup truck or tractor ball hitch connector. The spindle support member is secured to and extended transversely of the axle and wheel support assembly. Each spindle support assembly includes a spindle support disc having an upright support axle or shaft connected to a central support member. The add-on spindle support assemblies are identical, each including an add-on spindle assembly mounted on an add-on spindle support member and releasably connected by an anchor member to respective outer opposite ends of the spindle support member. Each add-on spindle support assembly includes a spindle support disc with a central support member having a central upright support axle or shaft. The add-on spindle support members are mountable by being telescopingly received within opposite respective ends of the main spindle support member and secured thereto by the anchor member which is a connector nut and bolt member. This selectively extends the add-on structure from three of the spindle support assemblies which each receives a spool of wire thereon to four or five spindle support assemblies.

OBJECTS OF THE INVENTION

One object of this invention is to provide a multiple wire dispensing assembly which is readily attachable to a three-point hitch assembly on a conventional farm tractor and operable to receive a plurality of spaced spools of wire thereon for ease of unraveling during construction of a fence post and wire assembly.

Another object of this invention is to provide a multiple wire dispensing assembly operable to receive thereon a plurality of spools of wire for dispensing independent wire strands concurrently and equally therefrom for ease of attaching to respective, spaced fence posts.

One other object of this invention is to provide a multiple wire dispensing assembly which can be connected to a conventional farm tractor assembly to be pulled thereby and having a spool of wire mounted on a spindle support assembly so as to achieve controlled unwinding of a wire strand therefrom due to frictional contact of the spool of wire with a spool support disc on an upper concave support surface thereon.

One further object of this invention is to provide a multiple wire dispensing assembly having a hitch connector assembly connected to a farm tractor assembly for vertical movement thereon; a spindle support member connected to the hitch connector assembly; and a plurality of spindle support assemblies mounted on a spindle support member; and each of the spindle support assemblies operable to support and train respective wire strands from a spool of wire for construction of a fence post and wire assembly.

One further object of this invention is to provide another embodiment being an add-on multiple wire dispensing assembly including a trailer hitch assembly for readily connecting to a pickup truck or tractor hitch member and having add-on spindle support assemblies so that the wire dispensing assembly can be increased from a dispensing structure with three spools of wire to a dispensing structure with five spools of wire.

Still, one further object of this invention is to provide an add-on multiple wire dispensing assembly including a spindle support member with three spindle support assemblies mounted thereon and having means for attaching on an additional add-on spindle support assembly at each opposite end being constructed with a width having three of the spindle support assemblies for ease of moving through farm gates and the like but can be readily extended with the add-on spindle support assemblies to four, five, or more units to a desire width.

Still, another object of this invention is to provide an add-on multiple wire dispensing assembly having removable outer add-on spindle support assemblies so as to be readily movable through gates of limited width and then expanded to additional overall width for use in dispensing wire from spools of wire for building wire fences and the like.

Still, one other object of this invention is to provide a multiple wire dispensing assembly which is readily attachable to a conventional farm tractor assembly; sturdy in construction; easy to use; economical to manufacture; and substantially maintenance free.

Various other objects, advantages, and features of the invention will become apparent to those skilled in the art from the following discussion, taken in conjunction with the accompanying drawings, in which:

FIGURES OF THE INVENTION

Figure 5:
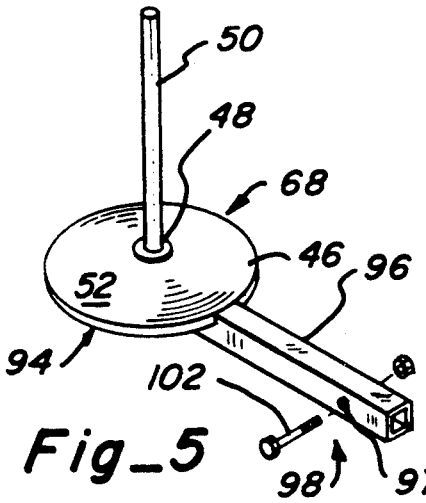
Figure 7:
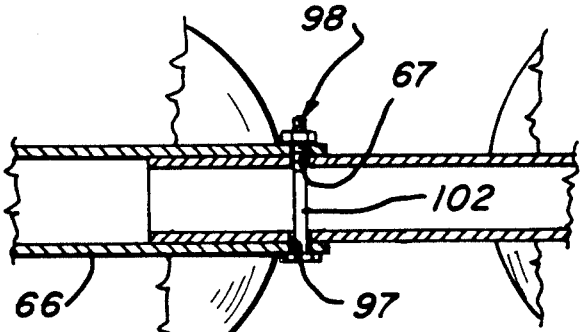
Figure 6:
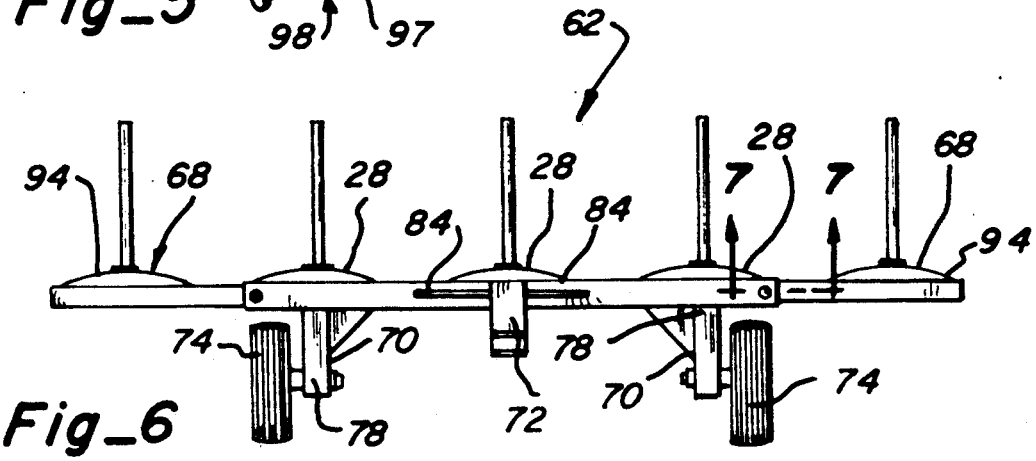

4 is a perspective view of a second embodiment of this invention being an add-on multiple wire dispensing assembly illustrating a spool of wire and an add-on spindle support assembly in dotted lines;

FIG. 5 is a perspective view of an add-on spindle support assembly operable to be attached to the add-on multiple wire dispensing assembly;

FIG. 6 is a front elevational view of the add-on multiple wire dispensing assembly of this invention illustrating an assembled unit with the add-on spindle support assemblies connected thereto; and FIG. 7 is an enlarged fragmentary sectional view taken along line 7—7 in FIG. 6 illustrating means for attachment of the add-on spindle support assembly to the add-on multiple wire dispensing assembly.

The following is a discussion and description of preferred specific embodiments of the multiple wire dispensing assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 1:
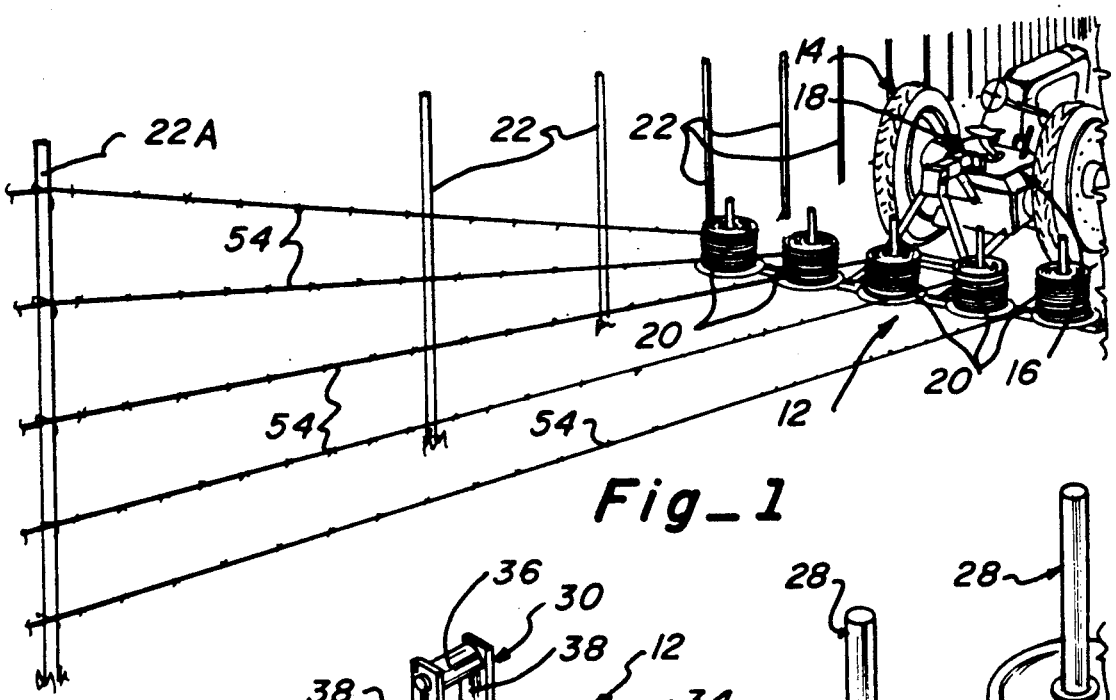
FIG. 1 is a perspective view illustrating a farm tractor assembly having a multiple wire dispensing assembly of this invention connected thereto and showing the attachment of wire strands to respective upright spaced fence posts.

Referring to the drawings in detail, and in particular to FIG. 1, a multiple wire dispensing assembly of this invention, indicated generally at 12, is illustrated as attached to a farm tractor assembly 14 through a three-point hitch assembly 16 which is pivotally movable in a conventional manner through the use of a hydraulic control assembly 18. It is noted that a plurality of spools of wire 20 are attached to the multiple wire dispensing assembly 12 and being dispensed therefrom in a manner to be explained.

The multiple wire dispensing assembly 12 includes 1) a hitch connector assembly 24 operably connectable to the three-point hitch assembly 16; 2) a spindle support member 26 connected to the hitch connector assembly 24; and 3) a plurality of spindle support assemblies 28, namely five (5) thereof, are secured to an upper main support surface 27 of the spindle support member 26 and operable to receive respective spools of wire 20 thereon as will be described.

Figure 2:
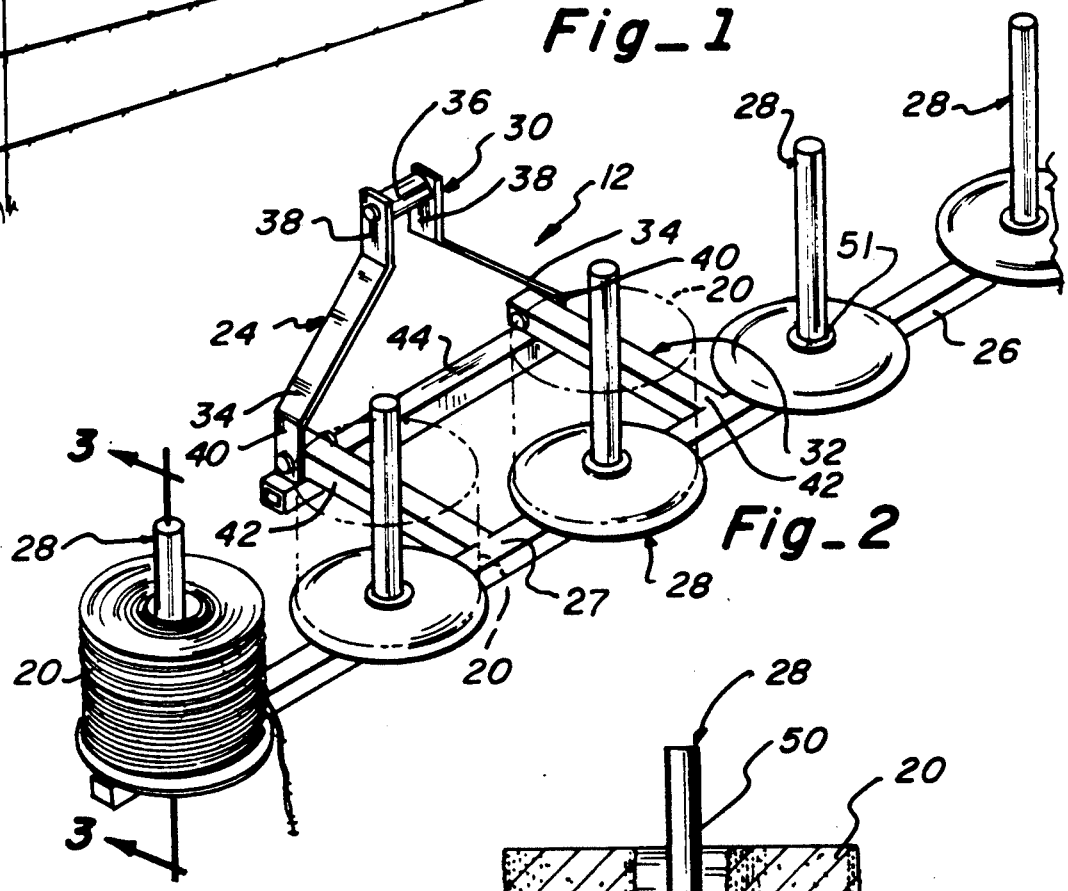
FIG. 2 is a fragmentary perspective view of the multiple wire dispensing assembly of this invention having spools of wire indicated thereon.

As noted in FIG. 2, the hitch connector assembly 24 includes an upper support assembly 30 having a lower support assembly 32 connected thereto. The upper support assembly 30 includes spaced inclined support arms 84 interconnected at an upper end by a connector member 36. The support arms 34 are each provided with an upper section 38 integral with a lower section 40. The lower section 40 and the connector member 36 are each adapted to receive a support arm from the three-point hitch assembly 16 on the farm tractor assembly 14 so that the upper support assembly 30 is operable to be moved vertically by connection to the lower section 40 and pivotal by a support arm connection to the connector member 36.

The lower support assembly 32 includes a pair of spaced parallel support bars 42 interconnected at adjacent ends to a transverse support bar 44 which, in turn, is connected to the upper support assembly 30. The support bars 42 and transverse support bar 44 are preferably of a square shape in transverse cross section so as to present a rigid structure for movement of the spindle support member 26 and interconnected spindle support assemblies 28.

The spindle support member 26 is interconnected at a central section to outer ends of the parallel support bars 42 as by welding or the like.

As noted in FIG. 8, each spindle support assembly 28 includes 1) a spool support disc 46 centrally secured to the main support surface 27 of the spindle support member 26; 2) a central support member 48 positioned centrally of the spool support base 46 and secured to the main support surface 27 of the spindle support member 26; and 3) an upright support axle or shaft 50 having a lower end secured to and mounted within a central opening 51 in the central support member 48.

The support disc member 46 is provided with an upper support surface 52 of concave shape to receive the respective spool of wire 20 thereon and to achieve frictional contact as will be explained.

The upright support axle or shaft 50 is of a length to extend above the respective heights of the spools of wire 20 and provide a guide member to hold the spool of wire 20 thereon during the fence building and wire unraveling method of use to be described.

Figure 4:
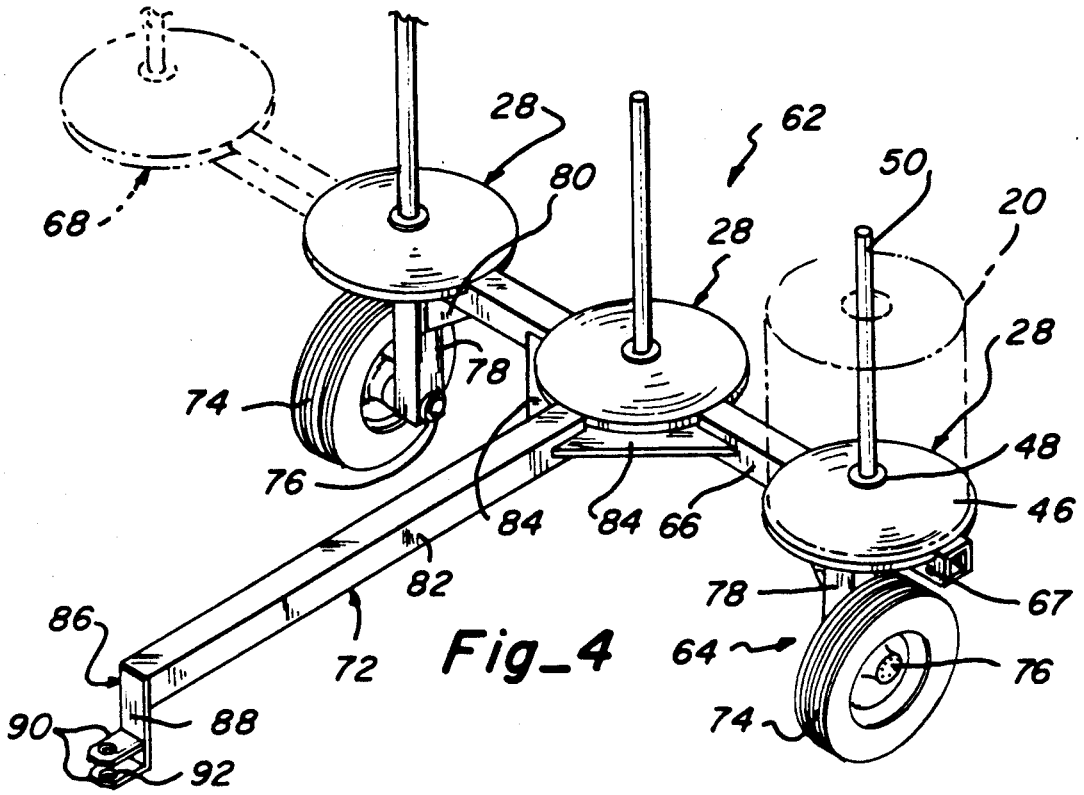

In a second embodiment of this invention as noted in FIG. 4, an add-on multiple wire dispensing assembly, indicated generally at 62, is operable to be readily attachable to a tractor or a trailer hitch on a pickup truck or the like for ease of transporting similar to any trailer structure mounted on wheel members as will become obvious.

The add-on multiple wire dispensing assembly 62, includes 1) a trailer hitch connector assembly 64; 2) a spindle support member 66 mounted on the trailer hitch connector assembly 64; 3) a plurality of spindle support assemblies 28, namely three thereof, mounted on the spindle support member 66; and 4) a pair of add-on spindle support assemblies 68 selectively and releasably connectable to opposite ends of the spindle support member 66 in a manner to be explained.

As noted in FIG. 4, the trailer hitch connector assembly 64 includes 1) an axle and wheel support assembly 70; and 2) a trailer hitch assembly 72 connected and forwardly projected from the axle and wheel support assembly 70 for connecting to the tractor or pickup truck trailer hitch member (not shown).

The axle and wheel support assembly 70 includes a pair of spaced wheel members 74, each interconnected to a support shaft 76 which, in turn, is connected to a vertical support member 78 secured as by a support strut member 80 to an adjacent portion of the spindle support member 66. Each vertical support member 78 is connected to an outer end of the spindle support member 66 so that the wheel 74 are in a spaced parallel relationship for normal support and movement similar to a trailer structure.

The trailer hitch assembly 72 includes an elongated hitch tongue member 82 secured by support struts 84 to an adjacent side wall of the spindle support member 66 and, additionally, having secured at an outer end thereof a hitch connector assembly 86. The hitch tongue member 82 is generally of a square tubular shape in transverse cross section operable to maintain a spaced relationship of the axle and wheel support assembly 70 from the interconnected trailer or pickup truck hitch member.

The hitch connector assembly 86 includes an upright support plate 88 having connected thereto a pair of parallel connector plates 90. The connector plates 90 are provided with aligned pin connector holes 92 for connection as by a lock pin or nut and bolt member (not shown) to a cooperating member on the tractor or pickup truck hitch member.

The spindle support member 66 is of generally square tubular shape in transverse cross section and having, at outer opposite ends thereof, a pair of aligned anchor openings 67 through the upright side walls for a connecting means as will be described.

The spindle support assemblies 28, being three thereof as noted in FIG. 1, are as preciously described each having 1) a spindle support disc member 46; 2) a central support member 48; and 3) an upright support axle or shaft 50 connected to the central support member 48.

Each of the spindle support disc members 46 have an upper support surface 52 of generally concave shape for receiving the spool of wire 20 thereon and operable in a manner to be described.

As noted in FIG. 5, each of the add-on spindle support assemblies 68 include 1) an add-on spindle assembly 94; 2) an add-on spindle support member 96 having the add-on spindle assembly 94 connected to an outer end thereof; and 3) an anchor member 98 operable to releasably attach the add-on spindle support member 96 to the respective outer ends of the spindle support member 66 in a manner to be explained.

Each add-on spindle assembly,94 includes 1) a spindle support disc 46; 2) a central support member 48 secured to a center portion of the spindle support disc 46; and 3) an upright support axle or shaft 50 secured to the central support member 48. Each spindle support disc 46 has an upper support surface 52 of concave shape for receiving a spool of wire 20 thereon.

The add-on spindle support member 96 is of generally square tubular shape in transverse cross section and having anchor holes 97 in the outer upright side walls.

The anchor member 98 includes a connector nut and bolt member 107 which is operable to be placed through the aligned anchor holes 97 and the anchor openings 67 for anchoring purposes as noted in FIG. 7 and as will be explained.

USE AND OPERATION OF THE INVENTION

In the use and operation of the multiple wire dispensing assembly 12 of this invention, it is obvious that the structure is first connected to the three-point hitch assembly 16 on the farm tractor assembly 14. The three-point hitch assembly 16 is operated through the hydraulic control assembly 18 in a manner well known in the prior art and interconnected to the hitch connector assembly 24 at the connector member 36 and the lower sections 40 of the support arms 34. The three-point hitch assembly 16 can then be operated through the hydraulic control assembly 18 so as to move the entire multiple wire dispensing assembly 12 in a vertical direction or provide a tilting action through independent lateral movement of the connector member 36.

Figure 3:
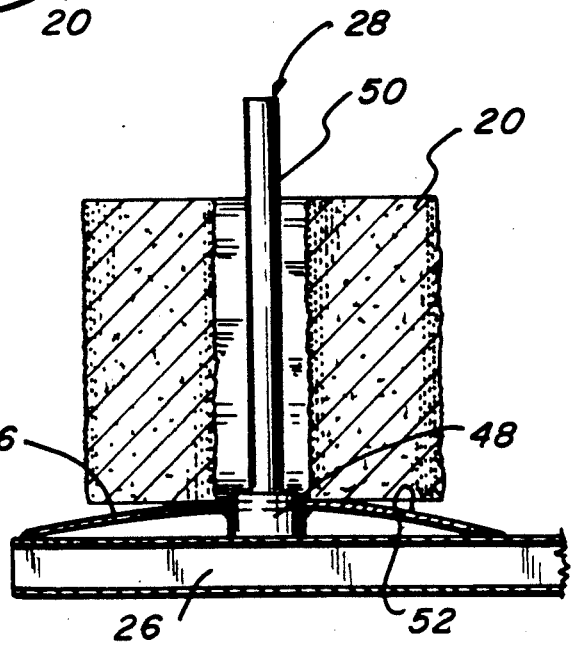
FIG. 3 is an enlarged fragmentary sectional view taken along line 3—3 in FIG. 2.

The operator of the multiple wire dispensing assembly 12 would then place a respective spool of wire 20 about respective ones of the upright support axle or shaft 50 of the spindle support assembles 28 as noted in FIG. 3. The operator would then move the entire interconnected structure through operation of the farm tractor assembly 14 to an area in which a fence building operation was to take place.

As noted in FIG. 1, the fence posts 22 are anchored in a ground surface and extended vertically thereof in a spaced relationship. The operator would then take a wire strand 54 from each one of the respective spools of wire 20 and interconnect same in a vertically spaced, sequential position on the upright fence post 22 as noted on the specific fence post 22A shown on the left side in FIG. 1. It is obvious the wire strand 54 from the spool of wire 20 adjacent to the roll of fence posts 22 would be attached to a top portion of a respective fence post 22 and the spool of wire 20 furthest from the fence post 22 would be attached to a lower portion thereof and the other wire strands 54 secured in a sequential relationship as noted in FIG. 1.

Next, the operator would move the farm tractor assembly 14 in a forward motion generally parallel to a vertical plane containing the upright fence posts 22 to automatically dispense the spools of wire 20 from their interconnection to the respective ones of the spindle support assemblies 28.

On the unraveling of the wire strands 54 from the respective spools of wire 20, it is obvious that the operator would then sequentially attach the wire strands 54 to the respective adjacent fence posts 22 to continue the fence post and wire assembly building operation.

An important feature of this invention is the use of the spool support disc 46 having the upper support surface 52 of a concave nature so as to support and contact a lower surface of the spool of wire 20 mounted thereon. This achieves a frictional contact therewith so that when the wire strands 54 are being pulled therefrom, the frictional contact with the upper concave support surface 52 prevents the spools of wire 20 from freely rotating thereabout which overcome many problems of the prior art fence building structures. When the farm tractor assembly 14 is moved forwardly, the respective wire strands 54 will be trained therefrom and will be under a tension on the wire strands 54 without freewheeling of the respective spools of wire 20 on their spindle support assemblies 28. This achieves the new and novel operation and function of this invention.

In the use and operation of the add-on multiple wire dispensing assembly 62, it is noted that the axle and wheel support assembly 70 is connected to the trailer hitch assembly 72 which can be readily attached to a tractor or pickup truck hitch member through use of an upright lock pin extended through the pin connector holes 92 in the hitch connector assembly 86. This will allow the entire add-on multiple wire dispensing assembly 62 to be trailed behind a vehicle being supported on the spaced wheel members 74.

It is noted that the spindle support assemblies 28 mounted on the spindle support member 66 are used as previously described to receive a respective spool of wire 20 thereon for dispensing which can be utilized for construction of a three strand wire fence system. Additionally, use of three of the spindle support assemblies 28 provides an overall structure having considerably less width than the multiple wire dispensing assembly 12 for ease of moving through fence gates, barn doors, on tow-lane highways and roads, and the like which is not achieved by the first embodiment of this invention.

It is noted that the add-on multiple wire dispensing assembly 62 can be readily converted to a five wire spool dispensing structure by adding an add-on spindle support assembly 68 to respective opposite ends of the spindle support member 66. As noted in dotted lines in FIG. 4, addition of the add-on spindle support assembly 68 is readily accomplished by telescoping a respective add-on spindle support member 96 within the larger, similarly square tubular shaped spindle support member 66 and moving such that the horizontally extending anchor opening 67 and anchor holes 97 are aligned. Then, the anchor member 98 and, more particularly, the connector nut and bolt member 102 is inserted through the aligned openings 67, 97 and secured as by the nut member to achieve the locked condition in FIG. 7. It is obvious that this is achieved on each opposite end of the spindle support member 66 to achieve the overall assembled structure as noted in FIG. 6.

It is noted that the multiple wire dispensing assembly of this invention is sturdy in construction; easy to attach and detach from a farm tractor assembly; easy to operate; and substantially maintenance free.

While the invention has been described in conjunction with preferred specific embodiments thereof, it will be understood this description is intended to illustrate and not to limit the scope of the invention, which is defined by the following claims:

We claim:

1. A multiple wire dispensing assembly attachable to a hitch assembly, comprising:

a) a hitch connector assembly connected to a hitch assembly;

b) a spindle support member connected to said hitch connector assembly;

c) a spindle support assembly connected to said spindle support member;

d) said spindle support assembly includes a spool support disc secured to said spindle support member and a support shaft secured to said spool support disc and extended upwardly therefrom;

e) said spool support disc having an upper surface to receive a spool of wire thereon; and f) an add-on spindle support assembly selectively connected to said spindle support member including an add-on spool support disc to receive another spool of wire thereon;

whereby the spool of wire includes a wire strand which is pulled therefrom to rotate and unravel said spool of wire on said spool support discs and frictional contact therebetween achieves a controlled rotational movement of the spool of wire to maintain the wire strand under tension.

2. A multiple wire dispensing assembly as described in claim 1, wherein:

a) said spindle support assembly includes said add-on support disc having a central support member secured centrally of said support disc and having an upright support shaft mounted therein.

3. A multiple wire dispensing assembly as described in claim 1, wherein:

a) said add-on spool support disc provided with an upper support surface of concave shape so as to frictionally engage a portion of the spool of wire for controlled rotational movement thereon while unraveling the wire strand therefrom.

4. A multiple wire dispensing assembly as described in claim 1, including:

a) a plurality of said add-on spindle support assemblies selectively connected in spaced relationship on respective outer ends and spindle support member so as to unravel a wire strand from respective spools of wire therefrom;

whereby said multiple wire dispensing assembly is operable to attach a wire strand from spools of wire on an upright fence post in an efficient and effective manner.

5. A multiple wire dispensing assembly as described in claim 4, wherein:

a) each of said add-on spindle assemblies having said add-on spool support disc with an upper concave support surface to receive the respective spools of wire thereon and to achieve frictional contact for controlled rotational movement of the spools of wire thereon during a fence building operation.

6. A multiple wire dispensing assembly as described in claim 1, wherein:

a) said add-on spindle support assembly includes an anchor member to selectively connect same to said spindle support member.

7. An add-on multiple wire dispensing assembly attachable to a hitch connector assembly which is connectable to a hitch member on a vehicle, comprising:

a) an axle and wheel support assembly connected to a hitch connector assembly;

b) a spindle support member connected to said hitch connector assembly;

c) a spindle support assembly connected to said spindle support member;

d) said spindle support assembly includes a spool support disc secured to said spindle support member and a support shaft secured to said spool support disc and extended upwardly therefrom; and e) an add-on spindle support assembly connected to an outer end of said spindle support member to receive a spool of wire thereon;

whereby the spool of wire includes a wire strand which is pulled therefrom to rotate and unravel said spool of wire on said spool support discs and frictional contact therebetween achieves a controlled rotational movement of the spool of wire to maintain the wire strand under tension.

8. An add-on multiple wire dispensing assembly as described in claim 7, wherein:

a) said add-on spindle support assembly includes a central support member secured centrally of a support disc and having an upright support shaft mounted therein.

9. An add-on multiple wire dispensing assembly as described in claim 8, wherein:

a) said spool support disc provided with an upper support surface of concave shape so as to frictionally engage a portion of the spool of wire for controlled rotational movement thereon while unraveling the wire strand therefrom.

10. An add-on multiple wire dispensing assembly as described in claim 7, wherein:

a) another of said add-on spindle support assemblies mounted on another spaced outer end of said spindle support member so as to unravel a wire strand from respective spools of wire therefrom;

whereby said multiple wire dispensing assembly is operable to attach a wire strand from spools of wire on an upright fence post in an efficient and effective manner.

11. An add-on multiple wire dispensing assembly as described in claim 8, wherein:

a) said spool support disc having an upper concave support surface to receive the respective spools of wire thereon and to achieve frictional contact for controlled rotational movement of the spools of wire thereon during a fence building operation.

* * * * *